US009226596B2

(12) United States Patent
Beevers et al.

(10) Patent No.: US 9,226,596 B2
(45) Date of Patent: Jan. 5, 2016

(54) INFANT SUPPORT DEVICE

(71) Applicant: Beevers Manufacturing & Supply, Inc., McMinnville, OR (US)

(72) Inventors: Timothy R. Beevers, McMinnville, OR (US); Katherine K. Beevers, McMinnville, OR (US)

(73) Assignee: SALTER LABS, Lake Forest, IL (US)

( * ) Notice: Subject to any disclaimer, the term of this patent is extended or adjusted under 35 U.S.C. 154(b) by 17 days.

(21) Appl. No.: 13/925,254

(22) Filed: Jun. 24, 2013

(65) Prior Publication Data

US 2013/0283536 A1 Oct. 31, 2013

Related U.S. Application Data

(63) Continuation-in-part of application No. 12/861,074, filed on Aug. 23, 2010, now Pat. No. 8,468,629.

(60) Provisional application No. 61/763,082, filed on Feb. 11, 2013.

(51) Int. Cl.

| | |
|---|---|
| ***B68G 5/00*** | (2006.01) |
| ***A47C 16/00*** | (2006.01) |
| ***A47D 13/08*** | (2006.01) |
| ***A61G 11/00*** | (2006.01) |

(52) U.S. Cl.

CPC ..... *A47D 13/08* (2013.01); *A61G 11/008* (2013.01); *A61G 2210/30* (2013.01)

(58) Field of Classification Search

CPC . A47D 13/08; A47D 11/008; A47D 2210/30; A47D 7/00; A47D 9/00; A47D 13/00

USPC ..... 5/482, 632, 630, 625, 633, 634, 924, 5/603, 655

See application file for complete search history.

(56) References Cited

U.S. PATENT DOCUMENTS

| | | | | | |
|---|---|---|---|---|---|
| 224,272 | A | * | 2/1880 | Buell | 297/118 |
| 2,429,350 | A | * | 10/1947 | Farrand | 5/98.1 |
| 3,110,519 | A | * | 11/1963 | Chernivsky | 297/285 |
| 3,423,773 | A | * | 1/1969 | Yamate | 5/610 |
| 3,487,479 | A | * | 1/1970 | Grooms | 5/93.1 |
| 4,193,150 | A | * | 3/1980 | Vineberg | 5/632 |
| 4,550,901 | A | * | 11/1985 | Muchisky et al. | 5/630 |
| 4,790,042 | A | * | 12/1988 | Reich | 5/655 |
| 4,926,512 | A | * | 5/1990 | Coyle | 5/417 |
| 4,941,465 | A | * | 7/1990 | Borschneck | 602/19 |
| 5,020,854 | A | * | 6/1991 | Powell | 297/377 |
| 5,133,098 | A | * | 7/1992 | Weber | 5/655 |
| 5,261,133 | A | * | 11/1993 | Wilkerson | 5/655 |
| 5,269,591 | A | * | 12/1993 | Miga et al. | 297/452.13 |
| 5,305,754 | A | * | 4/1994 | Honeywell et al. | 5/626 |
| 5,360,258 | A | * | 11/1994 | Alivizatos | 297/440.11 |
| 5,371,909 | A | * | 12/1994 | McCarty | 5/655 |
| 5,425,381 | A | * | 6/1995 | Peterson et al. | 5/652 |

(Continued)

*Primary Examiner* — David E Sosnowski

(74) *Attorney, Agent, or Firm* — Timothy E. Siegel Patent Law, PLLC; Timothy E. Siegel

(57) ABSTRACT

An infant holding device, including an infant holding portion, including a ductile sheet covered with infant-compatible material and a stand portion, adapted to support the infant holding portion in a vertically diagonal position, so that the infant holding portion thereby has a top and a bottom. In one preferred embodiment the ductile sheet is made of aluminum. In an additional preferred embodiment the infant holding portion is separable from the stand portion.

24 Claims, 6 Drawing Sheets

(56) References Cited

U.S. PATENT DOCUMENTS

| | | | | |
|---|---|---|---|---|
| 5,437,069 | A * | 8/1995 | Bates | 5/633 |
| 5,553,921 | A * | 9/1996 | Schenk | 297/352 |
| 5,755,492 | A * | 5/1998 | Iver | 297/377 |
| 5,918,335 | A * | 7/1999 | Han | 5/655 |
| 5,927,806 | A * | 7/1999 | Ohlson | 297/256.17 |
| 5,996,153 | A * | 12/1999 | Slater et al. | 5/655 |
| 6,199,229 | B1 * | 3/2001 | Wong | 5/417 |
| 6,250,712 | B1 * | 6/2001 | Livington et al. | 297/4 |
| D456,162 | S * | 4/2002 | Peters | D6/368 |
| 6,481,032 | B2 * | 11/2002 | Milano et al. | 5/655 |
| 6,682,137 | B2 * | 1/2004 | Hsia | 297/32 |
| 6,877,802 | B2 * | 4/2005 | Christensen et al. | 297/16.1 |
| 6,898,812 | B2 * | 5/2005 | Smart | 5/655 |
| 6,981,956 | B2 * | 1/2006 | Scheinberg et al. | 602/5 |
| 7,181,789 | B2 * | 2/2007 | Gatten | 5/494 |
| 7,329,229 | B2 * | 2/2008 | Scheinberg et al. | 602/5 |
| 7,412,737 | B2 * | 8/2008 | Hernadez | 5/655 |
| 7,562,406 | B1 * | 7/2009 | Leach | 5/655 |
| 7,793,371 | B1 * | 9/2010 | Leach | 5/632 |
| 7,895,690 | B2 * | 3/2011 | Kovalyak | 5/655 |
| 8,028,361 | B2 * | 10/2011 | Ramer et al. | 5/655 |
| 8,316,482 | B1 * | 11/2012 | Martin, III | 5/95 |
| 2005/0115000 | A1 * | 6/2005 | Kassai et al. | 5/655 |
| 2005/0210580 | A1 * | 9/2005 | Clapper | 5/93.1 |
| 2006/0096031 | A1 * | 5/2006 | Foster | 5/655 |
| 2006/0156471 | A1 * | 7/2006 | Cazzini et al. | 5/482 |
| 2008/0042402 | A1 * | 2/2008 | Nores | 280/644 |
| 2008/0052821 | A1 * | 3/2008 | Morton | 5/93.1 |
| 2008/0178387 | A1 * | 7/2008 | Kachtick-Anders | 5/603 |
| 2008/0209639 | A1 * | 9/2008 | Lord | 5/655 |
| 2009/0007336 | A1 * | 1/2009 | Kassai et al. | 5/655 |
| 2011/0119832 | A1 * | 5/2011 | Hung | 5/655 |
| 2012/0260427 | A1 * | 10/2012 | Lam | 5/603 |

* cited by examiner

INFANT SUPPORT DEVICE

CROSS REFERENCE TO RELATED APPLICATIONS

This application is a continuation-in-part of U.S. application Ser. No. 12/861,074 filed on Aug. 23, 2010 and claims priority from U.S. provisional application No. 61/763,082, filed on Feb. 11, 2013, which are incorporated by reference as if fully set forth herein.

BACKGROUND

Correct infant positioning is an important adjunct to the care of a premature infant. Although supporting and positioning the infant is recognized as a high priority, health care professionals have mostly used found objects to do the job, such as blankets, pillows, towels. Many positioning aids have been developed, but they have been primarily aimed at restraining movement in two-dimensions, helping to keep the baby from twisting or rolling around on the bed, for example. A simpler approach is the use of pillows or other objects to elevate the head. To accommodate wires and tubes, these devices can be deformed or the user can place several devices around the baby with spaces between them. Unfortunately, when the infant requires respiratory support this big, soft mass of positioning devices gets in the way of the tubing. Another approach, involving the use of small, spaced devices, reduces stability and complicates readjustment. Finally these materials often lose their shape over time, thereby requiring constant monitoring and adjustment.

There are a number of problems with these methods. First, they tend to use solid blocks, rolls, etc. that do not naturally accommodate tubing and wires. This makes it more difficult to attach tubing and wires to the baby without potentially injuring him/her by pushing, pulling, lifting or twisting. Second, they are not adapted to hold the baby above the surface of the bed which would provide a space between the baby and the bed through which wires could be extended; nor does it permit placing the baby at a specific, beneficial position in three dimensions and holding him/her there securely.

In addition, although it is known that a premature infant may be sensitive to the exact position into which he/she is placed, currently available infant support devices do not permit quick and accurate readjustment of infant position. As a consequence, valuable neonatal intensive care unit staff time may be spent readjusting pillows. At the same time, the needs of the infant are ill met, as a position adjustment takes longer and is made less precisely than would be desirable if possible.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In a first separate aspect the present invention may take the form of an infant holding device, including an infant holding portion, including a ductile sheet covered with infant-compatible material and a stand portion, adapted to support the infant holding portion in a vertically diagonal position, which thereby has a top and a bottom.

In one embodiment, the infant holding portion and the stand portion are formed from a single ductile sheet. In another embodiment the infant holding portion and the stand portion are separable, the stand portion being capable of supporting the infant holding portion by means of stand engagement elements located at the head and foot ends of the infant holding portion.

In a second separate aspect the present invention may take the form of a method of supporting an infant that uses an infant holding device including a ductile sheet covered with infant-compatible material. The infant holding device is bent into a shape adapted to retain the infant and the infant is placed into the infant holding device. In some embodiments, the position of the infant holding device is adjusted with respect to pitch angle or roll angle in order to hold the infant in a desired position.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced drawings. It is intended that the embodiments and figures disclosed herein are to be considered illustrative rather than restrictive.

DEFINITIONS

Ductile sheet: In the context of this application the term "ductile sheet" should be taken to mean a sheet of material that can be bent into a new shape by human hands and that then retains the new shape until bent again with at least an equal amount of force.

Human hands: In the above definition "human hands" means a pair of human hands having the amount of strength present in 95% of people between the ages of 15 and 75 years.

Sheet: In the above definition the word "sheet" encompasses both a solid or porous sheet of material such as metal or polymer and a thin mat of tightly woven, composite or layered material.

Infant-compatible: In the context of this application, "infant-compatible" means a material that can contact an infant without causing damage to the infant's skin. Accordingly, such a material is non-abrasive, smooth and hypo-allergenic.

Detailed Description of the Preferred Embodiments

Figures 1, 1A, 2:
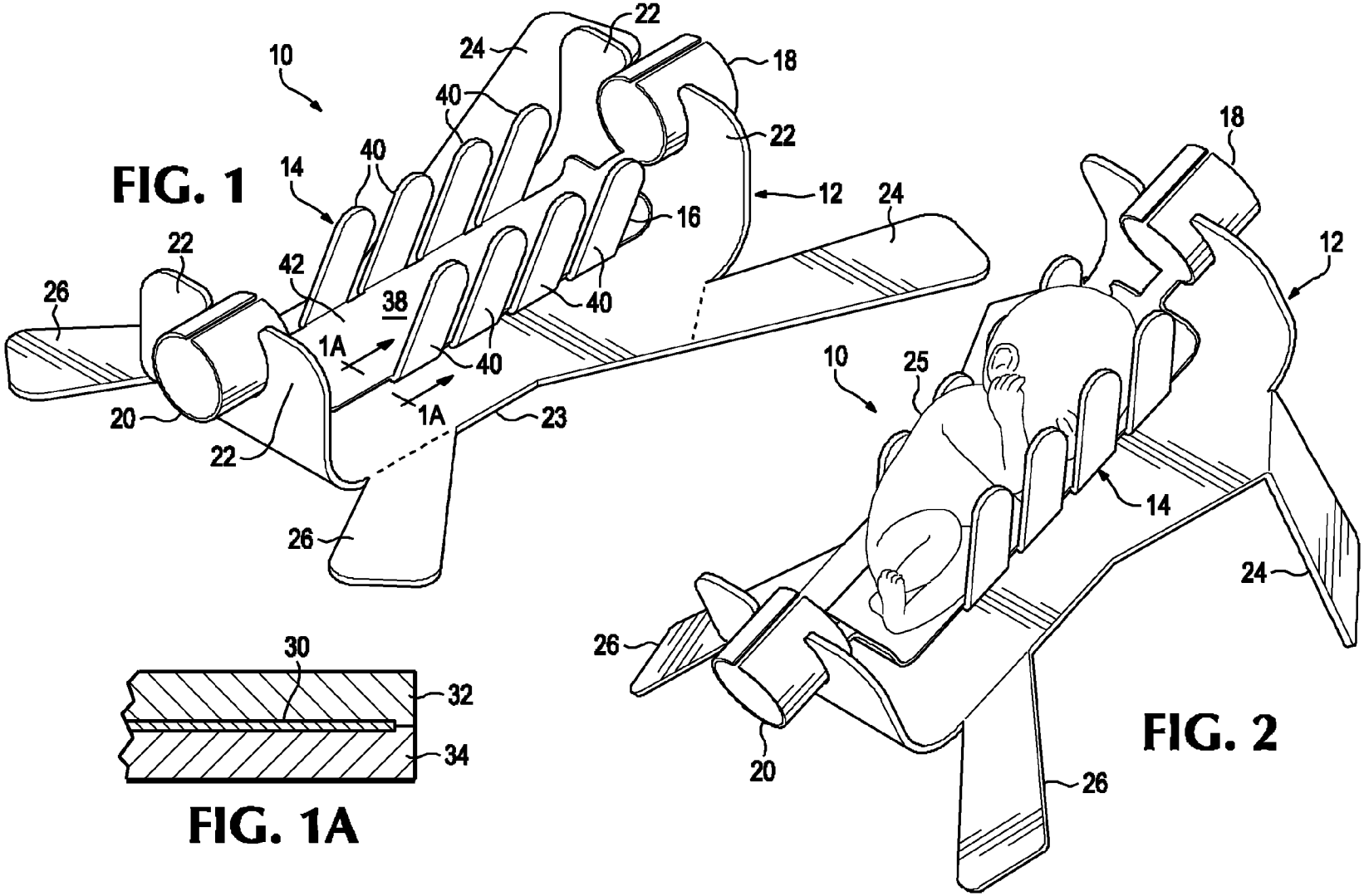
FIG. 1 is a perspective view of an infant support device according to the present invention, in an untilted state.
FIG. 1A is side sectional view of a portion of the infant support device of FIG. 1, taken along line A-A of FIG. 1.
FIG. 2 is a perspective view of the infant support device of FIG. 1, in its tilted state.

Referring to FIGS. 1 and 2, a preferred embodiment of an infant support assembly 10 is made of a stand 12, and a moveable element 14. Moveable element 14 includes an infant holding portion 16, to which is attached a head end stand engagement element 18 and a foot end stand engagement element 20. The stand, in turn, has two engagement element holders 22, supported by a stand body 23, each retaining one engagement element, 18 and 20, by a friction and tension fit. Each engagement element 18 and 20, is made of resilient material and is held in mild compression by an engagement element holder 22. Accordingly, the urge to expand of elements 18 and 20 keeps each in place in a holder 22, but is not so strong as to make it difficult to rotate elements 18 and 20 in holders 22. Accordingly, moveable element 14, and if in use, infant 25, stays in place between readjustments, but can also be easily rotated to a new position. A pair of long legs 24 and a pair of short legs 26 are all hinged onto the rest of stand 12, so that they may be placed into a flat position, as shown in FIG. 1, or a locked upright position, as shown in FIG. 2. With legs 24 and 26 upright, the moveable element 14 defines about a 30° angle with the surface, supporting infant support assembly 10.

Referring to FIG. 1A, infant holding portion 16 is made from a material having a center ductile sheet 30 covered with an infant-side layer 32 of infant compatible soft, foam material, and an outside layer 34 of a flexible foam material. Preferably, the center ductile sheet 30 is made of nearly pure aluminum such as an Aluminum Association Type 1XXX aluminum, and preferably Type 1145 aluminum sheet material (99.45% pure) having a thickness in the range of 0.2 mm (0.008 inch) to 2 mm (0.079 inch), and preferably having a thickness of about 1.29 mm. (0.0508 inch). Preferably, the metal is annealed to a dead soft or "O" temper. Bending the center ductile sheet 30 during the process of adjusting the support 10 to conform to a desired shape increases the rigidity (i.e. stiffness) of the support. Although aluminum is a natural candidate for the ductile core sheet 30, other ductile materials could be used. Other metals, such as iron and nickel are malleable and it is possible that a sheet of stainless steel having a thickness of less than a millimeter, could possess the required bending and shape-holding to meet the definition of "ductile material" set forth in this application. Other materials, such as a tightly-woven fiberglass or carbon-fiber mat or various composites and foams, may also be able to meet this definition.

The infant-side layer 32 of padding material has a thickness of about 6 mm (¼ in), although other thicknesses may be used. Layer 32 should also be somewhat resiliently compressible and porous and is therefore made of open-cell polymeric foam, such as a polyurethane foam, with an applied layer of flexible pressure sensitive adhesive. An acceptable density for such foam material is 0.5-4.0 lbs. per cubic foot, with 0.75 lbs.-3.0 lbs. per cubic foot being preferred. An indentation load deflection of about 25 is preferred, but any value up to 40 is acceptable, to provide sufficient firmness yet be comfortable. The open-cell construction of the infant-side layer 32 of padding material allows sufficient circulation of air, to cool and to dissipate any moisture from the skin of an infant using the support 10, to provide comfort and safe conditions for the infant. One acceptable material for the infant-side layer 32 is available from Foamex, of Compton, Calif., as its Foam Grade F 145 44 F.6 FA 44145-304.

In an alternative preferred embodiment, support 10 includes a fabric covering made of a soft and absorbent or moisture-wicking fabric with a significant amount of elasticity to accommodate differing bending transformations of support 10. For example, a brushed terrycloth or boucle fleece of 65 percent polyester and 35 percent rayon fiber of 100 denier yarn, available from Eclat Textile Co. Ltd. of City of Industry, Calif., as its product number 1206D performs well for absorbing moisture and exudate from an infant's skin. Preferably, such a cloth is a low loop, tightly knitted material, brushed to provide a soft and slightly matted surface which is absorbent and not abrasive, so that support 10 can be used comfortably in direct contact with the infant's skin. In one preferred embodiment, the fabric covering around support 10 is shaped to fit snugly around fingers 40, like a glove. In an alternative preferred embodiment, the fabric covering around support 10 is shaped to span the gaps between fingers 40, like a mitten.

The outside layer 34 of padding material has a thickness preferably in the range of 2 mm inch to 7 mm. The layer 34 of padding material should be of a somewhat resiliently compressible or elastomeric material, and may be of a polymeric foam such as a closed cell microcellular low density expanded polyethylene available from Voltek Division of Sakisui American Corporation, as Volara Type A foam. Such foam material used as layer 34 preferably has a density of at least about 1.0 lbs. per cubic foot and preferably at least 2.0 lbs. per cubic foot. In an alternative preferred embodiment, outside layer 34 is a infant-compatible polymeric sheet, as opposed to a foam. Skilled persons will be familiar with a wide range of infant compatible polymers. In a further alternative embodiment, center ductile sheet 30 is a polymeric sheet with layers 32 and 34 sealed together about the sheet. In yet another preferred embodiment, an outer seal of silicone or other adhesive is provided.

In one preferred embodiment, engagement elements 18 and 20 are made of the same material as is infant holding portion 16, but in an alternative preferred embodiment, elements 18 and 20 are made of a more highly resilient material coated with a higher friction substance, to better engage holders 22. In one preferred embodiment, holders 22 include ears (not shown) that contact elements 18 and 22 over a larger surface area, for greater friction resistance, in order to help element 14 stay in place once positioned.

Infant holding portion 16, further includes an infant platform 38, and a set of fingers 40 extending outwardly and upwardly from infant platform 38. Fingers 40 can be curled up around infant 25 to affirmatively secure the infant. Although in FIGS. 1 and 2 moveable element 14 is shown at approximately a 30° upward tilt, in one preferred embodiment, legs 24 and 26 may be placed into a variety of positions, resulting in different tilts for element 14.

In one preferred embodiment, the spaces between fingers 40 can vary in width, becoming narrower further down toward infant platform 38. This embodiment permits the support of tubes and lines of varying thickness.

An infant support tab 42 is formed by a cut in infant platform 38. FIG. 2 shows tab 42 in use as intended, supporting an infant from sliding down the diagonally oriented infant platform 38. In an alternative preferred embodiment, a tab, like tab 42, is formed by attaching a small sheet of material to platform 38. Alternatively, tab 42 could be omitted with the function of supporting the baby provided by a finger that is bent inwardly to the correct supporting position.

Considering assembly 10, many advantages should now be apparent. One difficulty in the care of prematurely born, fragile infants, is the need to extend wires and tubing to different places on the infant. It is desirable, however, to keep these tubes and wires separated from the infant, except for in the place where they attach to the infant or to some other element that is attached to the infant. But when the infant is supported by cushions or padding, this can be difficult to do. Also, in some situations it may be difficult to access a wire or tube, in order to make an adjustment when a portion of a wire or tube is covered by a cushion.

In assembly 10, a great deal of open space is provided to thread wires and tubes (collectively "lines") and even to keep them separate, as there is space under the stand 12, as well as space between stand 12 and moveable portion 14, through which lines can be extended. It is even possible to extend lines through the open space defined by engagement elements 18 and 20. Moreover, the spaces between fingers 40 provide access to the infant 25. The position of infant 25 may be quickly changed, simply by rotating element 14 or by adjusting legs 24 and 26.

Figures 3, 4:
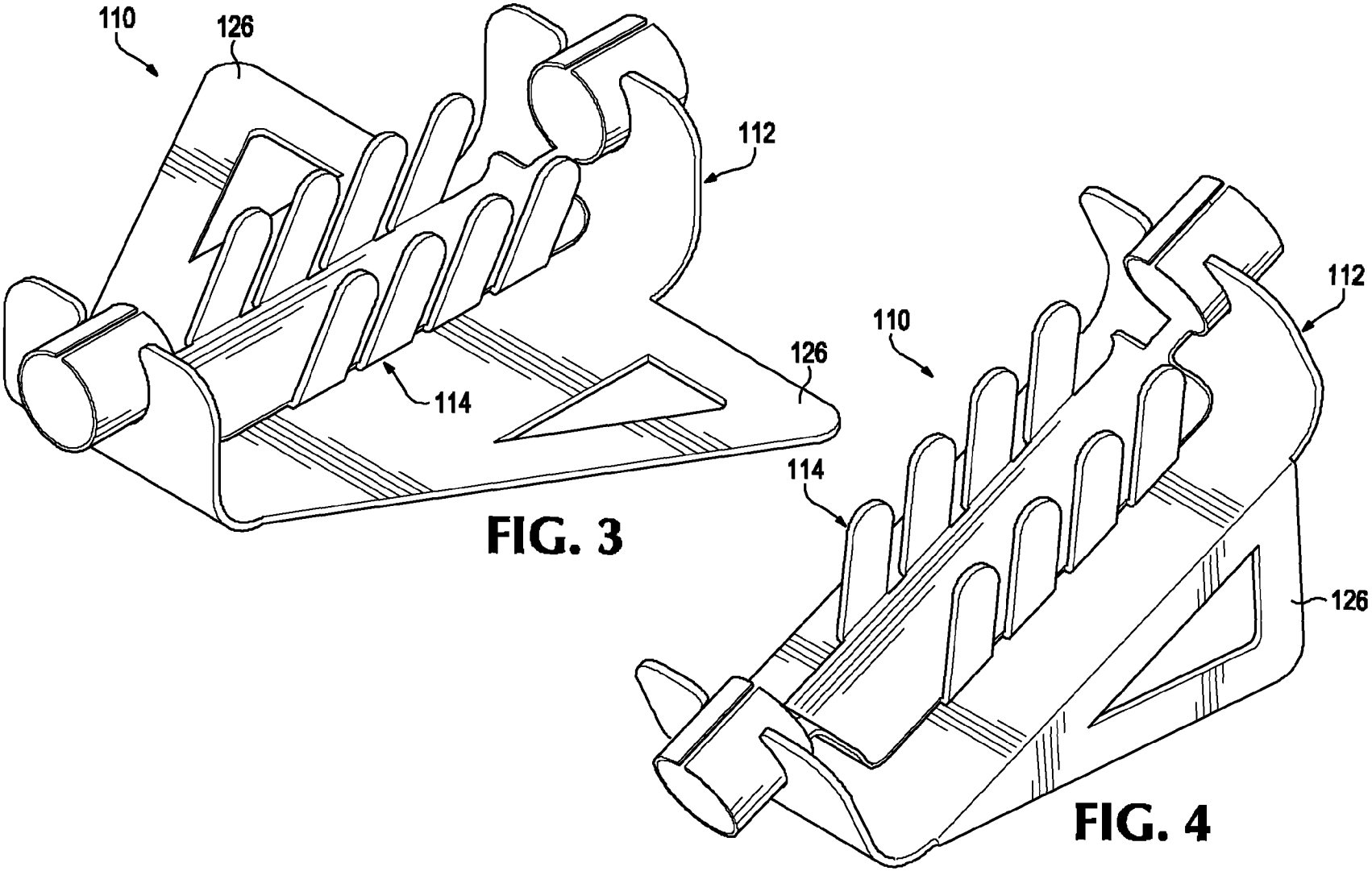
FIG. 3 is a perspective view of an alternative preferred embodiment of an infant support device, in its untilted position.
FIG. 4 is a perspective view of the infant support device of FIG. 3, in its tilted position.

Referring to FIGS. 3 and 4, in an alternative preferred embodiment of an infant holding assembly 110, stand 112 includes legs 126 that are foldable sideways to move from a flat position (FIG. 3), to a vertically diagonal position FIG. 4. A moveable portion 114 is the same as portion 14 of assembly 10.

Figure 5:
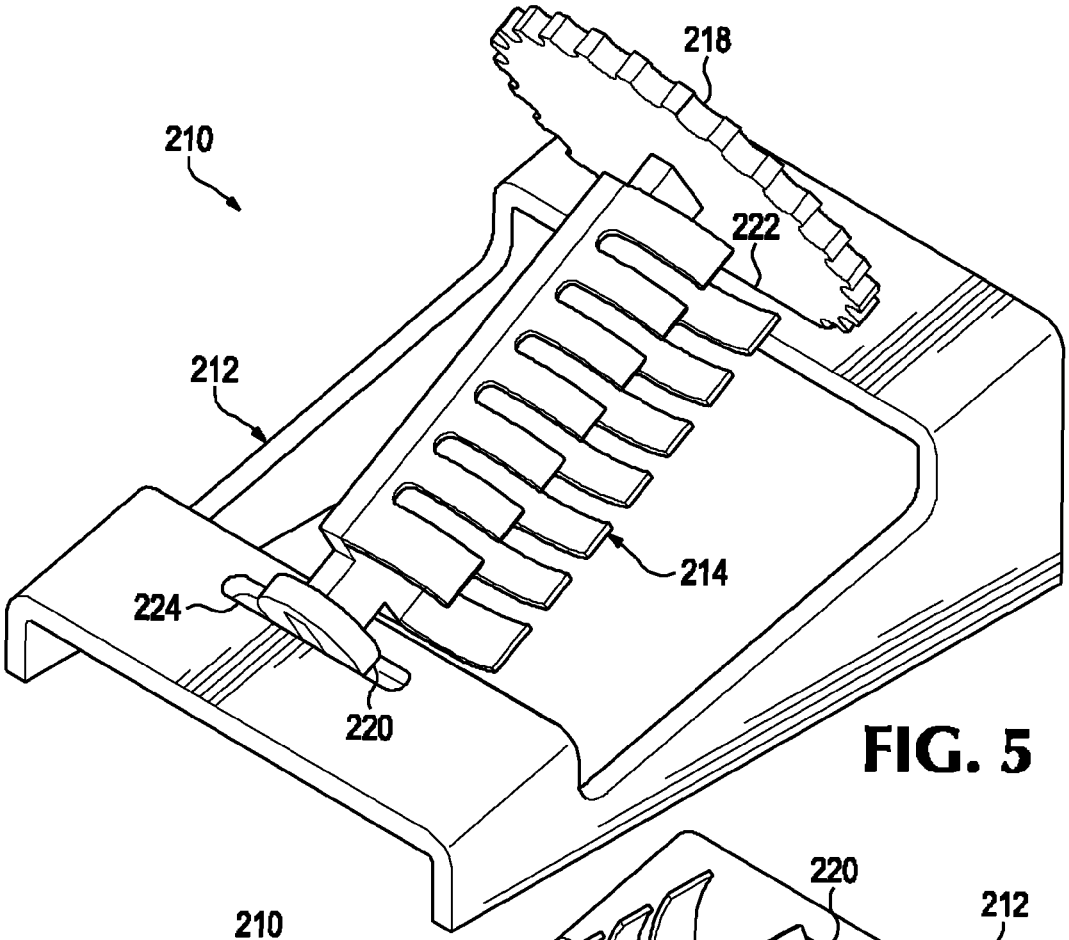
FIG. 5 is a perspective view of another alternative embodiment of an infant support device in its tilted and rotated state.
Figure 6:
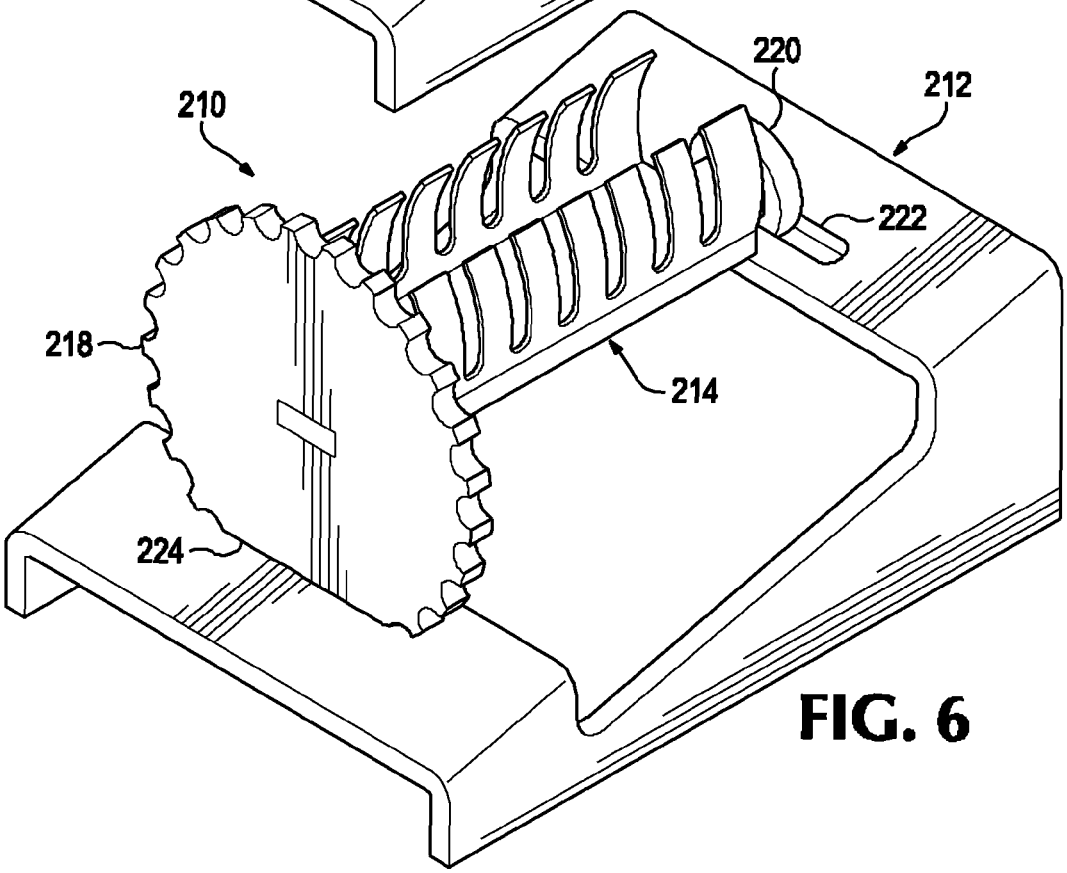
FIG. 6 is a perspective view of the infant support device of FIG. 5 in its untilted, unrotated state.

Referring now to FIGS. 5 and 6, in an alternative preferred embodiment of a fragile infant holding assembly 210, a stand 212 supports a moveable portion 214 that has a a first end enlarged gear stand engagement element 218, and a second end small round stand engagement element 220. Stand 212 defines a high slot 222 and a low slot 224, on opposite ends.

The roll angle can be changed by moving element 218 to a different engagement position, while the pitch can be changed by rotating moveable portion 214 by 180° and reengaging it so that element 218 mates with the lower slot, if it had previously engaged with the upper slot.

Figures 7, 8:
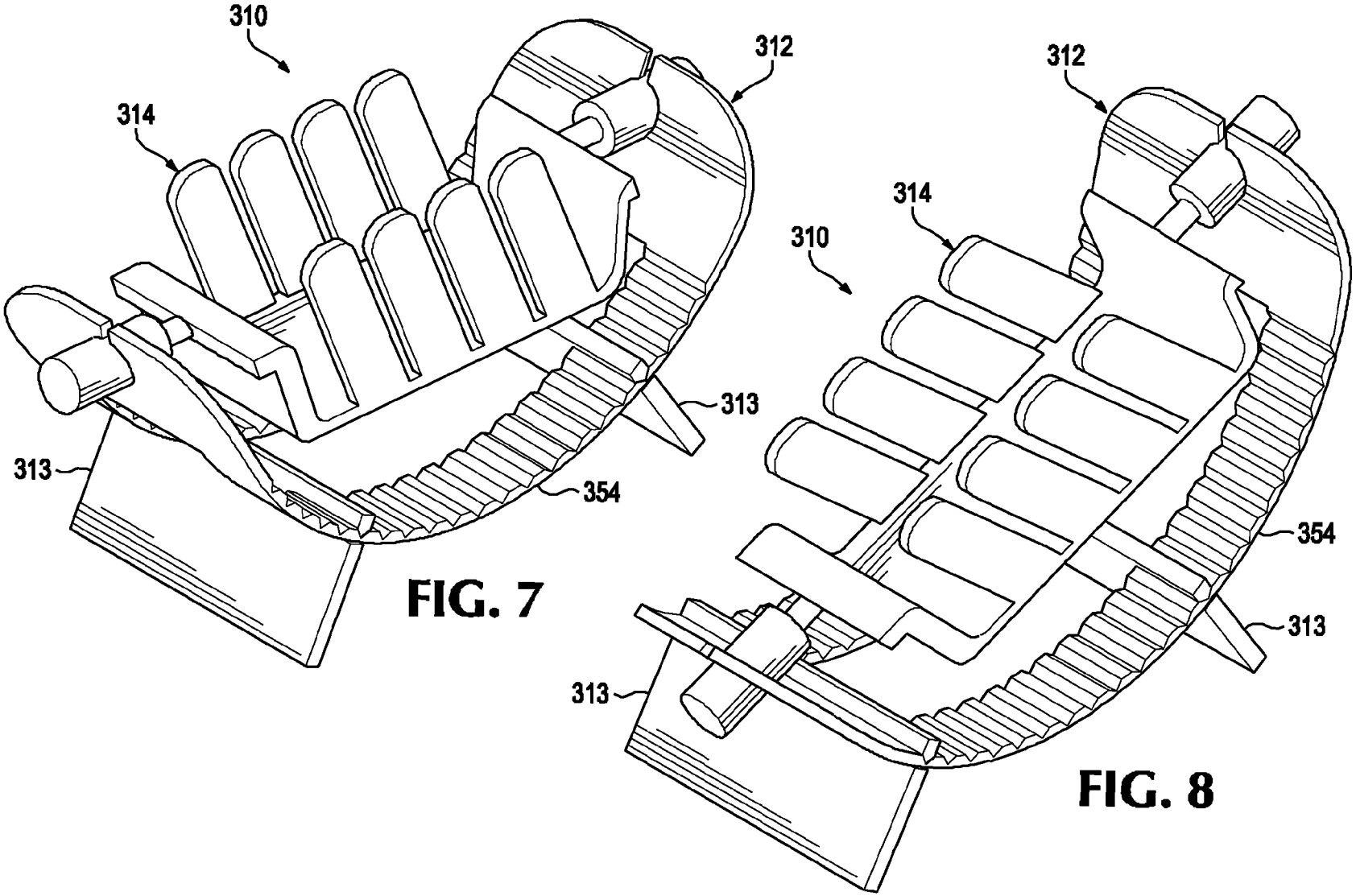
FIG. 7 is a perspective view of yet another preferred embodiment of an infant support device in its untilted state.
FIG. 8 is a perspective view of the infant support device of FIG. 7, in its tilted state.

Referring now to FIGS. 7 and 8, an embodiment of a fragile infant holding device 310 is shown that includes a stand 312 made of two stand leg elements 313 and a stand crescent 354, to which elements 313 selectively engage, to effect a fine gradation of pitch angles for a moveable portion 314. In a preferred variant, moveable portion 314 engages with crescent 354 in the same way that portion 14 engages with stand 12, for continuous roll angle adjustment.

Figure 9:
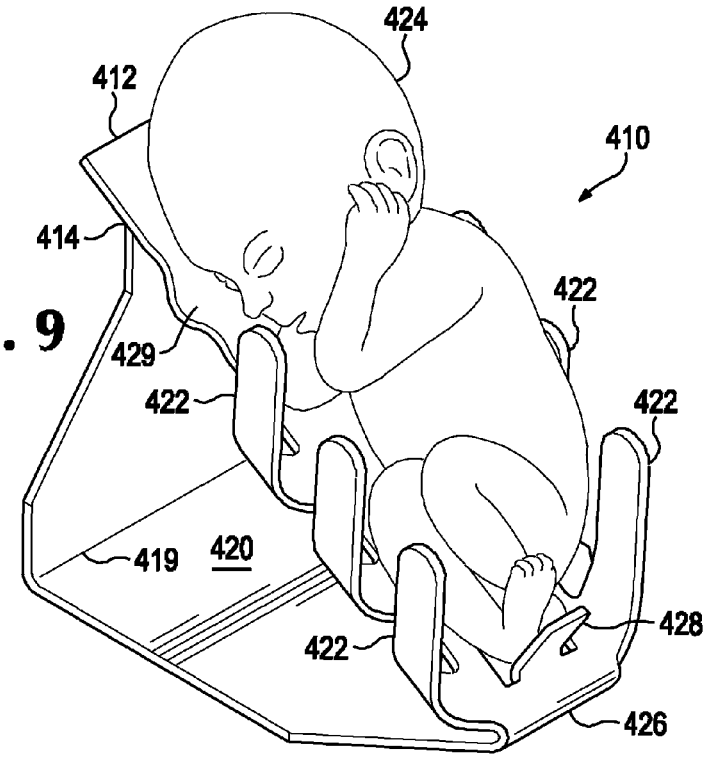
FIG. 9 is a perspective view of yet another alternative embodiment of an infant support device being used supporting an infant.
Figure 10:
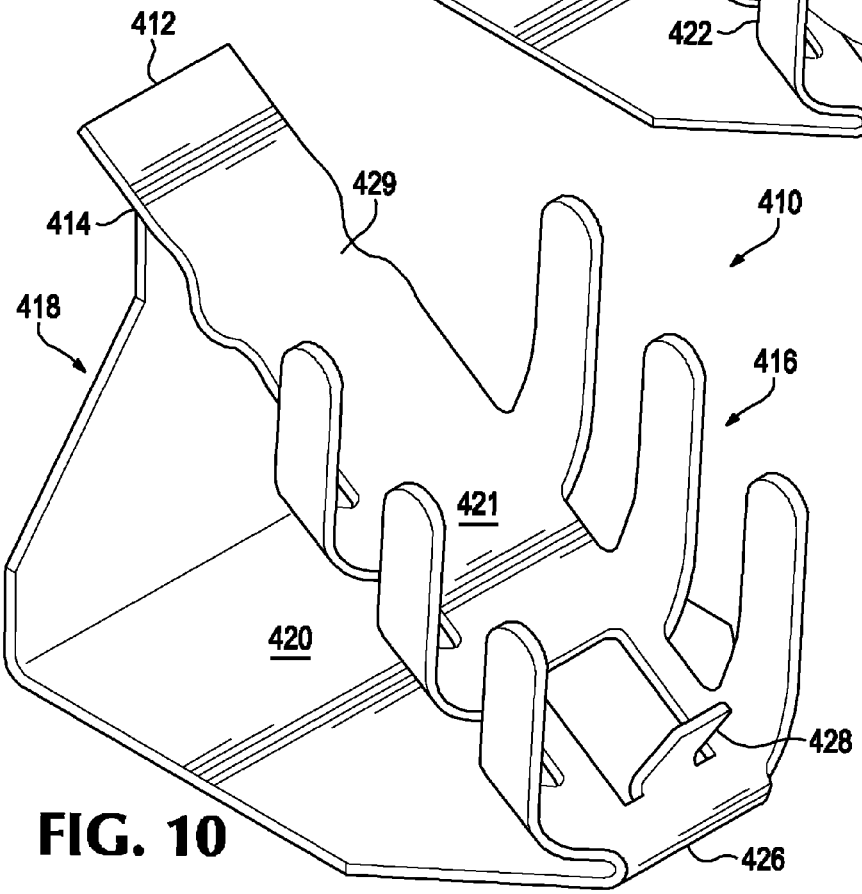
FIG. 10 is a perspective view of the infant support device of FIG. 9, shown without the infant.
Figure 11:
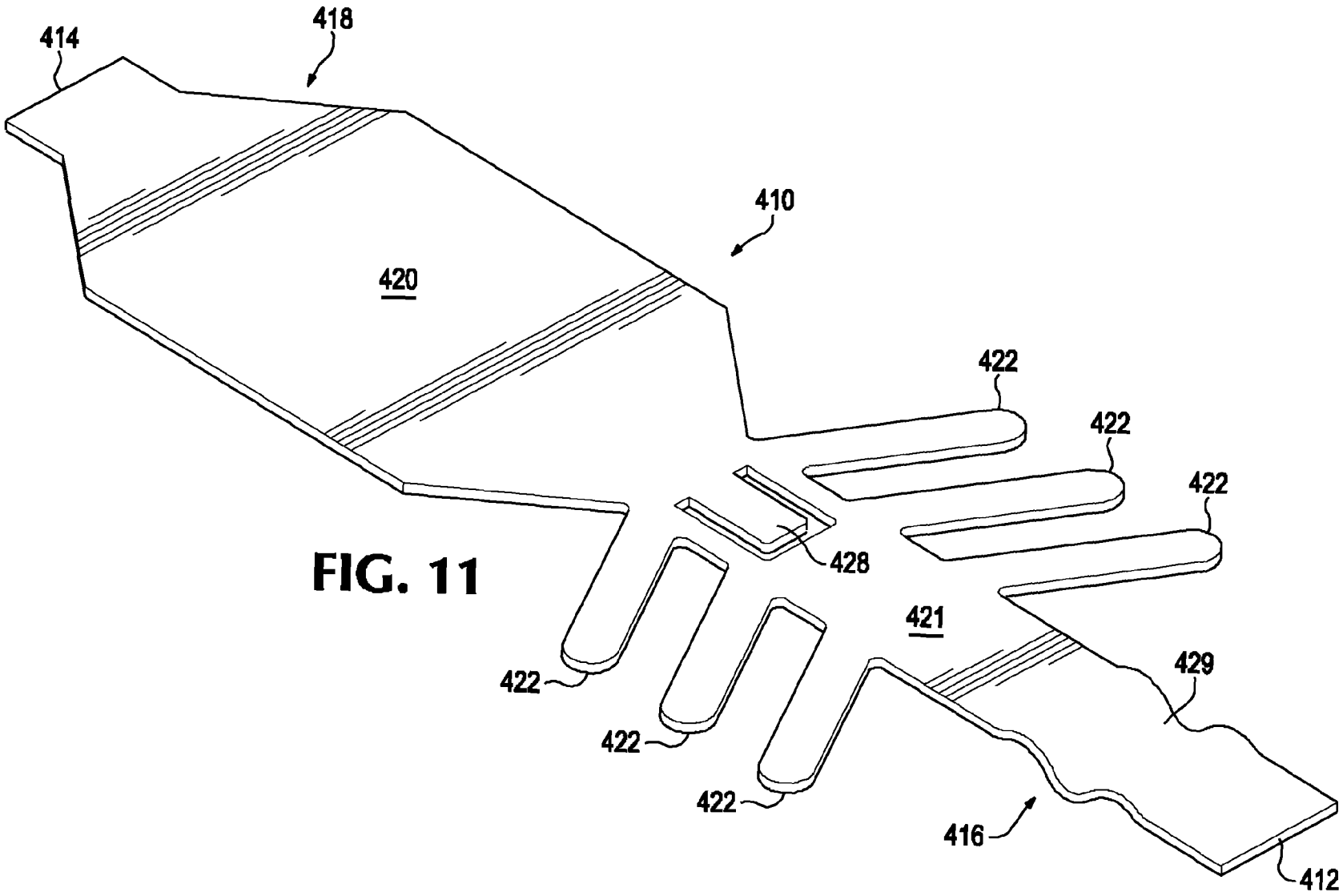
FIG. 11 is a perspective view of the infant support device of FIG. 9, shown in unfolded form.

Finally, referring to FIGS. 9-11, an infant support 410, is made of a piece of soft material (discussed further below) that is transversely resiliently deformable, but is also capable of being bent into and holding a shape. A first 412 and a second end 414 of support 410 are opposed to each other. Referring to FIGS. 9 and 10, support 410 can be bent into a vertical triangle, with an infant holding portion 416, proximal to first end 412, being supported by vertical portion 418. Portion 416 is connected to portion 418 by a medial portion 420, which serves as a base, when support 410 is in use. Portion 418 is distinguished from base 420 by a bend 419. Portion 416 includes an infant supporting platform 421 and a set of fingers 422, which project outwardly from the sides of a lower portion of platform 421. In use, fingers 422 are bent upwards to provide side-support to an infant 424. When support 410 is in this deployed configuration infant holding portion 416 has a top that is coincident with the first end 412 of support 410 and a bottom 426 at its juncture with segment 418.

Although in FIGS. 9 and 10 platform 421 is shown at approximately a 30° upward tilt, bend 419 could be formed nearer to or further from end 414 to create a shallower or a steeper slope for platform 421. In one configuration bend 419 is not formed and platform 421 is horizontal. Also, fingers 422 can be curled up around infant 424 to affirmatively secure the infant. An infant support tab 428 is formed by a cut in platform 421. FIG. 9 shows tab 428 in use as intended, supporting an infant from sliding down the diagonally oriented infant platform 421. In an alternative preferred embodiment a tab, like tab 428, is formed by attaching a small sheet of material to platform 421. Alternatively, tab 428 could be omitted with the function of supporting the baby provided by a finger that is bent inwardly to the correct supporting position. A scallop 429, for permitting tubes and insulated wires to pass under the neck of infant 424, is formed between 4 and 7 cm from top 412 of platform 421.

In an alternative preferred embodiment, medial segment 420 and vertical segment 418 are made of a different material from infant holding portion 416. For example these portions could be provided with a 90 degree angle already in place between portion 418 and 420, which could be made of a semi-rigid polymer sheet. In another preferred embodiment device 410 is provided already formed into a triangle, but with fingers 422 still extending to the side. In yet another preferred embodiment, fingers, similar to fingers 422 are attached to platform 421. This alternative permits a different material, having different material properties, to be used for the fingers than for platform 421.

It is most important that portion 416 be shaped into a form adapted to support a particular infant, although in some situations it will be important that the tilt of portion 416 be adjustable.

The above described embodiments of an infant holding assembly 10, 110, 210, 310 and 410 answer all the issues noted in the Background section. Each design permits rapid repositioning of an infant in both pitch and roll. Assemblies 10 and 110 permit an infinitely fine gradation of roll angle adjustment, whereas assembly 210 permits many choices as to roll angle. Assembly 310 permits a fine granularity of pitch angle adjustment.

As for infant holder 16, and the similar portions of assemblies 110, 210, 310 and 410, it is shaped loosely like a human hand and can be deformed to cuddle and hold the baby in a wide variety of natural and developmentally correct poses. The design allows for elevating or lowering the baby's body; for inclining or declining it; even for rotating it axially. The fingers 40 or 422 can be wrapped around the baby, keeping it securely in one position. The fingers 40 or 422 have spaces between them, and can be further moved by the user, to accommodate tubes, wires and devices. Also, tubes and wires can be secured to the device creating a strain relief at that point. When it is necessary to adjust the baby's position, the tubing, wires and devices may remain attached to support 10 as the entire collection can be adjusted as a unit.

While a number of exemplary aspects and embodiments have been discussed above, those possessed of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

We claim:

1. An infant holding assembly, comprising:

(a) a moveable element, including:

(i) an infant holding portion, sized and shaped to hold a small infant and having a head end and a foot end, and being bisected by a bisecting plane extending from said head end to said foot end and which includes a shaped sheet of ductile material covered in infant-compatible material and defines a set of fingers that can be wrapped about an infant, to hold said infant;

(ii) a foot end stand engagement element, attached to said foot end and a head end stand engagement element attached to said head end; and (b) a stand having two engagement element holders, collectively adapted to hold said foot end engagement element and said head end engagement element, and support said moveable element in an adjustable position, and whereby a pitch angle is defined as a vertical angle between said foot end engagement element and said head end engagement element and a roll angle is defined, as an angle by which said bisecting plane is moved away from vertical.

2. The infant holding device of claim 1, wherein said head end engagement element and said foot end engagement element engage said engagement element holders in a roll angle selectable manner.

3. The infant holding device of claim 2, wherein said roll angle is continuously adjustable.

4. The infant holding device of claim 2, wherein said head end engagement element has a cross-section of a circle and said engagement element holders each define a slot for accepting said circle at any one of a plurality of roll angles.

5. The infant holding device of claim 4, wherein said circle is smooth, permitting a fine gradation of adjustment.

6. The infant holding device of claim 4, wherein said circle has an opening in a location in its top half, whereby a line may be placed into said opening and supported by said circle.

7. The infant holding device of claim 1, wherein said stand further permits adjustment to said pitch angle.

8. The infant holding device of claim 7, wherein said pitch angle is selectable between two predetermined angles.

9. The infant holding device of claim 8, wherein said two predetermined angles are an angle of about zero degrees and an angle of about 30 degrees.

10. The infant holding device of claim 1, wherein said infant-compatible material is polymeric foam.

11. The infant holding device of claim 1, wherein said infant holding portion has a top surface, adapted to hold an infant, and a bottom surface, and wherein said infant-compatible material of said top surface is at least 3 mm thick.

12. The infant holding device of claim 1, wherein said infant holding portion has an infant-holding side, adapted for holding an infant, and an outside, and wherein said infant-compatible material on said outside is different from said infant-compatible material on said infant-holding side.

13. The infant holding device of claim 1, wherein said infant holding portion includes an infant holding central portion sized to receive an infant and wherein said fingers are adapted to be bent upwardly, to provide side support for an infant.

14. The infant holding device of claim 1 wherein the set of fingers comprises at least four fingers.

15. The infant holding device of claim 1, wherein said fingers extend obliquely away from said bisecting plane and in the direction of said head end.

16. A method of supporting a fragile infant, comprising the steps of:

(a) providing an infant holding assembly, including a stand and a moveable element, supported by and engaged to said stand, such that the position of said moveable element can be changed relative to said stand, with said moveable element keeping its changed position until moved again, said moveable element including a pliable infant supporting portion that includes an infant supporting central expanse and side extensions extending from opposing sides of said supporting central expanse;

(b) molding said pliable infant supporting portion to better support said infant and bending said side extensions about said infant; and (c) placing said fragile infant in said infant supporting portion.

17. The method of claim 16, further including extending a line to said infant, between said stand and said moveable element.

18. The method of claim 16, further including moving said moveable element, relative to said stand, to support said infant in a altered position.

19. The method of claim 16, wherein said infant supporting portion is made of a sheet of ductile material, covered with infant compatible material.

20. The method of claim 16, wherein said moveable element is position adjustable to introduce a longitudinal tilt to said infant supporting portion.

21. An infant holding assembly, comprising:

(a) a moveable element, including:

(i) an infant holding portion, sized and shaped to hold a small infant and having a head end and a foot end, and being bisected by a bisecting plane extending from said head end to said foot end;

(ii) a foot end stand engagement element, attached to said foot end and a head end stand engagement element attached to said head end; and (b) a stand having two engagement element holders, collectively adapted to hold said foot end engagement element and said head end engagement element, and support said moveable element in an adjustable position, and whereby a pitch angle is defined as a vertical angle between foot end engagement element and said head end engagement element and a roll angle is defined, as an angle by which said bisecting plane is moved away from vertical;

(c) wherein said head end engagement element and said foot end engagement element engage said engagement element holders in a roll angle selectable manner; and (d) wherein said head end engagement element has a cross-section of a circle and said engagement element holders each define a slot for accepting said circle at any one of a plurality of roll angles.

22. The infant holding device of claim 21, wherein said circle is smooth, permitting a fine gradation of adjustment.

23. The infant holding device of claim 21, wherein said circle has an opening in a location in its top half, whereby a line may be placed into said opening and supported by said circle.

24. The infant holding device of claim 21, wherein said circle bears a plurality of projections, collectively defining a discrete set of roll angles at which said circle fits into said slot.

* * * * *